US005098628A

United States Patent [19]

Okamoto et al.

[11] Patent Number: 5,098,628

[45] Date of Patent: Mar. 24, 1992

[54] CENTRIFUGAL MOLDING METHOD FOR COMPOSITE PIPE HAVING A RESIN CONCRETE LAYER

[75] Inventors: Hiroshi Okamoto, Takatsuki; Takaaki Kawano, Osaka; Toshiyuki Tsujiuchi, Takatsuki; Hidenori Katayama, Suita, all of Japan

[73] Assignee: Nippon Shokubai Co., Ltd., Osaka, Japan

[21] Appl. No.: 721,307

[22] Filed: Jun. 26, 1991

[51] Int. Cl.[5] ..... B28B 1/16; B28B 1/20

[52] U.S. Cl. ..... 264/256; 118/318; 138/97; 138/98; 264/270; 264/309; 264/311; 366/157; 425/435; 425/449; 427/426

[58] Field of Search ..... 425/435, 449; 118/306, 118/318; 427/426; 366/156, 157; 405/150; 138/97, 98; 264/69, 256, 311, 312, 40.1, 40.7, 270, 309

[56] References Cited

U.S. PATENT DOCUMENTS

| | | | |
|---|---|---|---|
| Re. 27,061 | 2/1971 | Rubenstein | 264/270 X |
| 3,029,027 | 4/1962 | Gray | 118/306 X |
| 3,150,219 | 9/1964 | Schmidt | 264/311 |
| 3,714,312 | 1/1973 | Nitta et al. | 264/311 |
| 3,768,943 | 10/1973 | Maihart | 425/435 X |
| 4,804,563 | 2/1989 | Hillemeier et al. | 427/426 X |

*Primary Examiner*—Karen D. Kutach Aftergut
*Attorney, Agent, or Firm*—Oblon, Spivak, McClelland, Maier & Neustadt

[57] ABSTRACT

A centrifugal molding method which can smooth the inner surface of the resin concrete layer of a resin concrete pipe or of a composite pipe having a resin concrete layer even without using any special sand conditioning mechanism and which is high in productivity includes producing a composite pipe having a resin concrete layer or producing a resin concrete pipe by moving an arm member of a pipe material feeding device forward and backward axially through a pipe forming outer mold rotating about an axis thereof and by feeding pipe materials from a discharge port formed in a front end of the arm member. The resin concrete layer is formed by feeding resin and aggregate to a mixing portion provided at the front end of the arm member through separate feed routes, mixing the two in the mixing portion and discharging the resulting mixed resin concrete material from the discharge port.

7 Claims, 3 Drawing Sheets

CENTRIFUGAL MOLDING METHOD FOR COMPOSITE PIPE HAVING A RESIN CONCRETE LAYER

FIELD OF THE INVENTION

The present invention is directed to a centrifugal molding method for composite pipe having a resin concrete layer.

BACKGROUND ART

A resin concrete pipe comprises an aggregate and a resin material and is superior in strength and corrosion resistance. Further, by forming a resin layer on the inner peripheral side and/or the outer peripheral side of a resin concrete layer there can be obtained a composite pipe more superior in corrosion resistance. Usually, a centrifugal molding method is used for producing a composite pipe having a resin concrete layer, which pipe will hereinafter be referred to sometimes merely as a "composite pipe", and for producing a resin concrete pipe. According to the centrifugal molding method, material is poured into a pipe forming outer mold while the outer mold is rotated about the axis thereof, and is formed into the shape of a pipe, which is then solidified and thereafter taken out from the pipe forming outer mold. In the centrifugal molding method, however, low productivity occurs be discussed later.

For forming a resin concrete layer in the pipe forming outer mold, various material feeding devices have been used, and there are known (1) a method wherein a resin material consisting of a resin and a hardening agent and an aggregate are fed from separate nozzles, and (2) a method wherein a resin concrete material is obtained by mixing an aggregate and a resin material in advance and is then transferred up to a front end portion of a material feeding device and fed. For example, the above method (1) is disclosed in Japanese Patent Publication No. 45923/86. In the case where a composite pipe 1 having resin layers 2 and 4 of the same composition formed on the inner and outer peripheral surfaces of a resin concrete layer 3, such as that shown in FIG. 3, is to be produced by the technique disclosed in said patent publication, there is used such a material feed arm as illustrated in FIG. 5. As shown therein, successively from a front end side of a material feed arm portion 50 there are disposed a first resin material feed portion 51, a chopped strand feed portion 52, a second resin material feed portion 53, a sand conditioning portion 54 and a sand feed portion 55. According to this method, a first resin material 61 and chopped strands 62 are fed to form an outer periphery-side resin layer 2, then a second resin material 63 and sand 64 are fed in this order, during forward movement of the material feed arm 50. During backward movement of the arm, as shown in FIG. 6, a sand conditioning plate 56 of the sand conditioning portion 54 extends and conditions an uneven surface of the sand to form a resin concrete layer 3, thereafter the chopped strands 62 and the first resin material 61 are fed to form a inner periphery-side resin layer 4.

The centrifugal molding method aims at forming layers each of uniform thickness while utilizing a centrifugal force created by the rotation of a mold. But in the method wherein sand and resin material are fed separately in forming a resin concrete layer, as mentioned above, the resin material and the aggregate are apt to be separated from each other due to a difference in specific gravity, resulting in that the combined use of both materials is not fully effective. Besides, since the aggregate is present on the inner surface side of pipe, the pipe inner surface does not become flat and there are formed concave and convex portions, as shown in FIG. 5. To avoid this inconvenience, it is necessary to level the pipe inner surface by using such a sand conditioning plate such as illustrated in FIGS. 5 and 6, resulting in productivity being deteriorated markedly.

Even if the pipe inner surface is levelled by the sand conditioning plate 56 or the like, it is difficult to obtain a uniform and smooth surface, and there remain uneven portions. In forming a resin layer over the whole surface of the concrete layer, therefore, there arises the problem that the amount of resin used becomes larger than necessary.

Also, as for the above method (1), Japanese Patent Laid Open No. 246704/87 discloses a method wherein first an aggregate is fed and then a liquid resin is fed. According to this method, however, a centrifugal force as large as 50G or so is required for impregnating the resin into the aggregate. Moreover, there are limitations on the thickness and grain size of the aggregate layer which permit the impregnation of resin therein, and in some particular thickness of a resin concrete layer in a composite pipe to be produced, it is required to repeat the aggregate feeding step and the resin impregnating step several times.

On the other hand, the foregoing method (2) is disclosed in Japanese Patent Laid Open No. 42207/89. In the conventional methods which had been known before the method (2), a resin concrete containing a room-temperature hardening agent adheres to a mixing machine and a material introducing device and solidifies, thus requiring a longer time for cleaning than for centrifugal molding. Taking note of this point, method (2) employs a thermosetting agent in place of said room-temperature hardening agent to prevent a resin concrete material from solidifying at room temperature, thereby facilitating the cleaning work. According to this method, however, although the solidification of resin can be prevented, it is necessary, after solidifying a pipe inner layer on a centrifugal molding apparatus, to transfer the pipe into a heating chamber and harden the pipe body portion, thus resulting in productivity being deteriorated markedly.

SUMMARY OF THE INVENTION

It is the object of the present invention to provide a centrifugal molding method which can smooth the inner surface of the resin concrete layer of a resin concrete pipe or of a composite pipe having a resin concrete layer even without using any special sand conditioning means and which is high in productivity.

According to the present invention which has attained the above-mentioned objects in a method of producing a composite pipe having a resin concrete layer or producing a resin concrete pipe by moving an arm member of a pipe material feeding device forward and backward axially through a pipe forming outer mold rotating about an axis thereof and by feeding pipe materials from a discharge port formed in a front end of the arm member, the resin concrete layer is formed by feeding resin and aggregate to a mixing portion provided at the front end of the arm member through separate feed routes, mixing the two in said mixing portion, and discharging the resulting mixed resin concrete material from the discharge port.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

In the present inventions an aggregate and a resin material are fed separately up to a front end portion of a pipe material feeding device and then mixed together just before they are fed to a pipe forming outer mold, to obtain a resin concrete material having fluidity. Therefore, the resin concrete material can be spread easily by a centrifugal force after the discharge thereof and so the pipe inner surface can be made smooth, thus eliminating the necessity of levelling the pipe inner surface using a suitable means such as a sand conditioning means. Even without using an especially large centrifugal force, it is possible to form a resin concrete layer at a time with resin fully impregnated into aggregate, thus permitting an improvement in production efficiency. Further, since aggregate and resin are mixed just before the discharge ports, materials which adhere to various portions of the molding apparatus can be removed easily because they adhere to those portions before the mixing, and hence the use of a room-temperature hardening agent will cause no problem. Thus, a heating step is not needed and the production time can be shortened; besides, since it is not necessary to perform cleaning of a resin concrete premixing machine and a resin concrete feeding machine, cleaning work efficiency is improved to a great extent.

Figure 1:
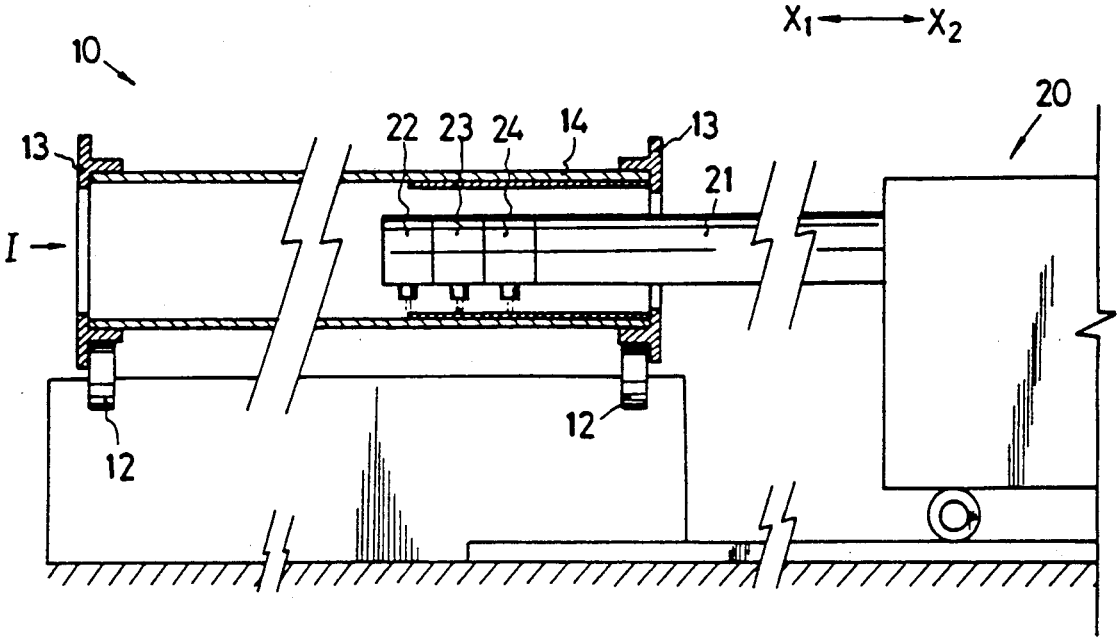
FIG. 1 is a schematic explanatory view showing a centrifugal molding apparatus for a composite pipe having a resin concrete layer.
Figure 2:
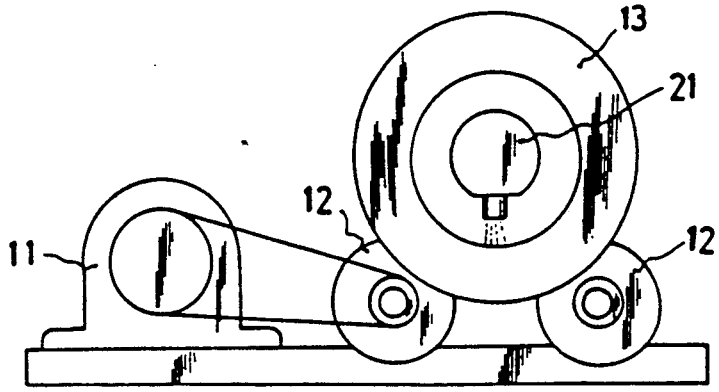
FIG. 2 is an explanatory view as seen in the direction of arrow I, showing the operating state of the apparatus illustrated in FIG. 1.
Figure 3:
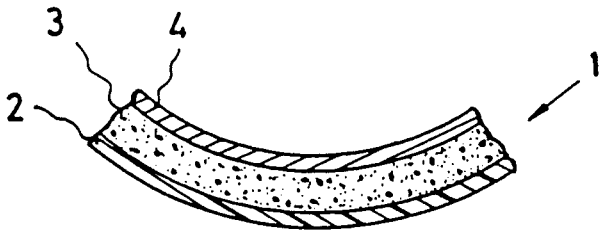
FIG. 3 is an explanatory sectional view showing an example of a composite pipe having a resin concrete layer.

FIG. 1 is a schematic explanatory view showing a centrifugal molding condition of a composite pipe (or a resin concrete pipe) having a resin concrete layer according to the present invention. The rotating mechanism for a pipe forming outer mold 14 is the same as in the prior art. As shown in FIG. 2, the pipe forming outer mold 14, with a forming jig 13 attached thereto, is rotatably mounted on rotating rollers 12, 12 connected to a driving motor 11. A platform car 20 is movable in the directions of arrows $X_1 \rightleftarrows X_2$ so that a material feed arm 21 can be inserted into and pulled out from a hollow portion of the pipe forming outer mold 14.

The method of the present invention is not limited by the apparatus used, but according to a typical construction of the material feed arm 21, a resin material feed portion 22, a chopped strand feed portion 23 and a resin concrete feed portion 24 are arranged successively from the front end side. Therefore, in feeding materials into the pipe forming outer mold, resin material, chopped strands and resin concrete are fed in this order to form an outer periphery-side resin layer and a middle resin concrete layer, during forward movement of the material feed arm 21, while at the time of backward movement of the same arm, chopped strands and resin material are fed to form an inner periphery-side resin layer.

In the prior art, resin and aggregate are fed separately, while the method of the present invention is characterized by mixing the two just before they are fed to the pipe forming outer mold and then feeding the resulting resin concrete material. For example, this can be attained by disposing the following mixing unit within the material feed arm 21.

Figure 4:
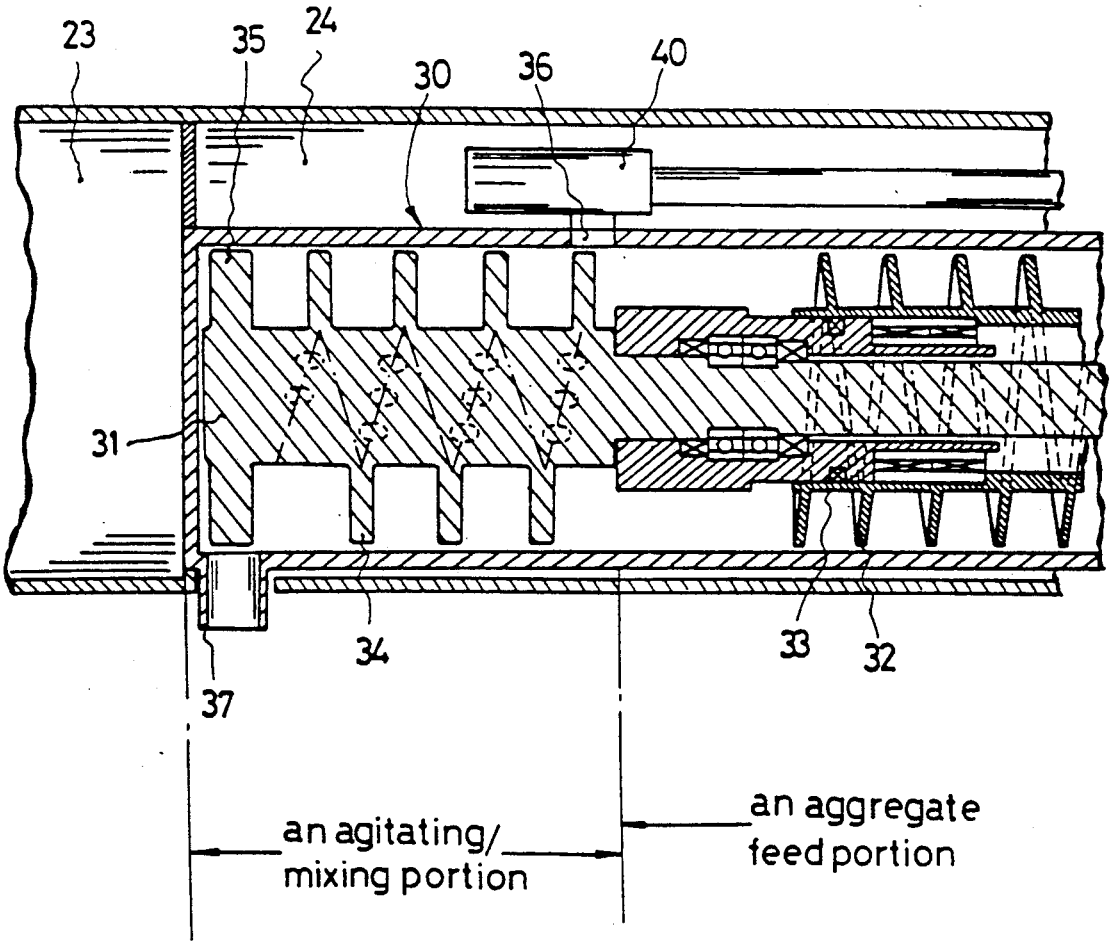
FIG. 4 is a schematic explanatory view showing a typical example of a resin concrete feed portion in the method of the present invention.
Figure 5:
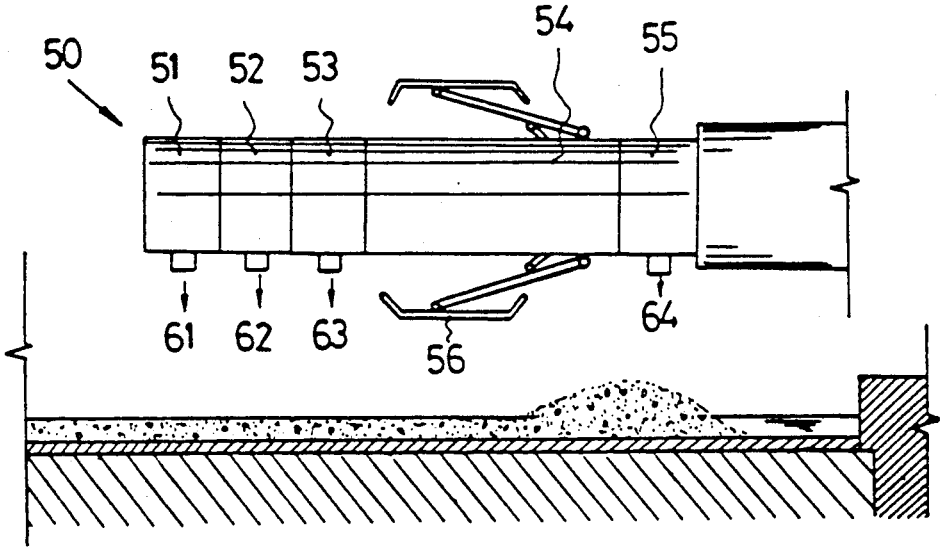
Fig 5 PRIOR ART
FIGS. 5 and 6 are schematic explanatory views showing a conventional material feed arm.
Figure 6:
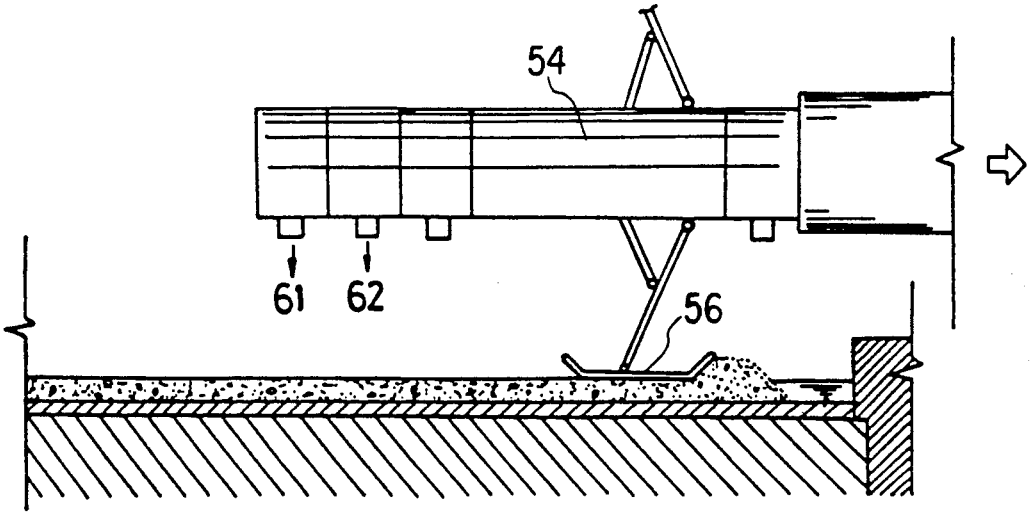
Fig 6 PRIOR ART

Referring now to FIG. 4, which is a schematic explanatory view showing a typical example of a mixing unit, a rotary shaft 31 is disposed along the axis of a cylindrical mixing unit 30 and substantially throughout the overall length of the mixing unit, and a hollow rotary shaft 33 having screw blades 32 formed on the outer peripheral surface thereof except a front end side is fitted on the rotary shaft 31 through bearings and sealing members. Aggregate is fed forward by the rotation of the hollow rotary shaft 33. On the outer peripheral surface portion of the rotary shaft 31 on which the hollow rotary shaft 33 is not fitted there are formed a plurality of pins 34 spirally projectingly in the outer peripheral direction. Further, on the outer peripheral surface of the front end of the rotary shaft 31 there are radially disposed resin concrete discharge blades 35 comprising a plurality of flat places.

On the other hand, disposed above and in parallel with the mixing unit 30 is a resin feed unit 40. Both units are in communication with each other through a resin material feed port 36 formed in an upper position of the outer cylindrical portion corresponding to the boundary between an agitating/mixing portion and an aggregate feed portion in the material feed arm. Further, a resin concrete discharge nozzle 37 is provided in a lower part of the front end of the mixing unit 30.

In the above construction, the feed of materials is performed in the following manner. First, an aggregate is fed to a hopper (not shown) and thereafter fed to the agitating/mixing portion located on the front end side of the mixing unit 30 by means of the screw blades 32. On the other hand, a resin material is fed under pressure from the resin material feed port 36 to the agitating-/mixing portion through the resin material feed unit 40 by means of a pump. In the agitating/mixing portion the aggregate and the resin material are mixed together by the spirally projecting a plurality of pins 34. At the same time, the thus-mixed resin concrete material is fed to the front end position of the material feed arm 30 and is discharged from the discharge nozzle 37 into the pipe forming outer mold by means of the resin concrete discharge blades 35.

Although no limitation is placed on the resin concrete material to be used in the invention, as examples of aggregates employable in the invention there are mentioned blends of crushed stones and/or siliceous sand and inorganic, finely powdered fillers (e.g. siliceous stone powder and calcium carbonate), while as examples of employable resins there are mentioned unsaturated polyester resins. And there may be added any of the conventional room-temperature hardening agents.

In this embodiment, moreover, since the rotary shaft 31 and the hollow rotary shaft 33 are controlled by separate variable speed motors, materials can be mixed certainly by changing the rotating speed of each rotary shaft according to the grain size and ingredients of the aggregate used and the kind of the resin material used.

A resin material with a hardening agent incorporated therein may be supplied to the resin feed unit 40. In this connection, if there is used a resin feed unit which permits a resin and a hardening agent to be fed separately and mixed together just before agitation, it is possible to further improve the productivity; for example, the hardening time can be shortened.

Further, if an electromagnetic clutch is interposed between a motor for driving the rotary shaft in the aggregate feed portion and the rotary shaft, then at the time of start-up of operation, by first turning on the motor and then engaging the clutch when a stable number of revolutions has been reached to transmit the rotation of the motor to the rotary shaft, it is made possible to feed a resin concrete wherein resin and aggregate are mixed in a predetermined ratio, already at the time of start-up of operation.

Since the present invention is constructed as above, there can be provided a molding method capable of producing a composite pipe having a resin concrete layer and also producing a resin concrete pipe, both having a smooth inner surface.

We claim:

1. A centrifugal molding method of producing a composite pipe having a resin concrete layer by moving an arm member of a pipe material feeding device forward and backward axially through a pipe forming outer mold which rotates about an axis of said arm member of said material feeding device and by discharging pipe materials from a discharge port formed in a front end of said arm member into said rotating pipe forming outer mold, which further comprises:

feeding a resin and a concrete aggregate through separate feed routes along said axis of said arm member to a mixing portion provided in said front end of said arm member adjacent said discharge port, mixing said resin and said aggregate together in said mixing portion to form a fluid resin concrete material, and discharging said fluid resin concrete material from said discharge port to form said resin concrete layer of said composite pipe.

2. A centrifugal molding method of producing a composite pipe having a resin concrete layer according to claim 1, wherein, in feeding said pipe materials into said pipe forming outer mold, a resin material, chopped strands and said resin concrete material are fed in this order to form an outer periphery-side resin layer and a middle resin concrete layer of said composite pipe during said forward movement of said arm member, while chopped strands and said resin material are fed to form an inner periphery-side resin layer of said composite pipe during said backward movement of said member.

3. A centrifugal molding method of producing a resin concrete pipe by moving an arm member of a pipe material feeding device forward and backward axially through a pipe forming outer mold which rotates about an axis of said arm member of said material feeding device and by discharging pipe materials from a discharge port formed in a front end of said arm member against said rotating pipe forming outer mold, which further comprises:

feeding a resin and a concrete aggregate through separate feed routes along said axis of said arm member to a mixing portion provided in said front end of said arm member adjacent said discharge port, mixing said resin and said aggregate together in said mixing portion to form a fluid resin concrete material, and discharging said fluid resin concrete material from said discharge port to form said resin concrete pipe.

4. A centrifugal molding method of producing a composite pipe having a resin concrete layer or of producing a resin concrete pipe, according to claims 1 or 3, respectively, wherein a resin concrete mixing unit is disposed within said arm member, said mixing unit having a concrete aggregate feed portion and said mixing portion, said aggregate feed portion and said mixing portion having respective rotary shafts which are driven separately, said mixing unit being connected to a resin feed unit in a position near a boundary between said aggregate feed portion and said mixing portion, and said resin and said aggregate being mixed together in said mixing portion just before being fed to said pipe forming outer mold from said discharge port as said resin concrete material.

5. A centrifugal molding method of producing a composite pipe having a resin concrete layer or of producing a resin concrete pipe according to claim 4, wherein in said mixing unit said rotary shaft in said aggregate feed portion and said rotary shaft in said mixing portion are separately controlled by variable speed motor.

6. A centrifugal molding method of producing a composite pipe having a resin concrete layer or of producing a resin concrete pipe according to claim 4, which comprises:

using a resin feed unit for mixing said resin and a hardening agent together just before said mixing of said resin with said aggregate, said resin feed unit having passages for feeding said resin and said hardening agent separately before said mixing together of said resin and said hardening agent.

7. A centrifugal molding method of producing a composite pipe having a resin concrete layer or of producing a resin concrete pipe according to claim 4, including a motor for driving said rotary shaft in said aggregate feed portion and an electromagnetic clutch interposed between said motor and said rotary shaft in said aggregate feed portion, wherein at a time of start-up of operation first said motor is turned on and then said electromagnetic clutch is engaged.

* * * * *